US010563547B1

(12) United States Patent
Camilo et al.

(10) Patent No.: US 10,563,547 B1
(45) Date of Patent: Feb. 18, 2020

(54) CAMSHAFT PHASER INCLUDING A TARGET WHEEL WITH A TIMING FEATURE

(71) Applicant: Schaeffler Technologies AG & Co. KG, Herzogenaurach (DE)

(72) Inventors: Alexandre Camilo, Rochester Hills, MI (US); Renato de Oliveira Ghiraldi, Madison Heights, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/139,123

(22) Filed: Sep. 24, 2018

(51) Int. Cl.
*F01L 1/344* (2006.01)
*F01L 13/00* (2006.01)

(52) U.S. Cl.
CPC ..... *F01L 1/344* (2013.01); *F01L 2001/3445* (2013.01); *F01L 2001/34483* (2013.01); *F01L 2013/111* (2013.01); *F01L 2820/041* (2013.01)

(58) Field of Classification Search
CPC ..... F01L 1/3442; F01L 2001/3445; F01L 2001/34483; F01L 1/46; F01L 2013/111; F01L 2820/041
USPC ..... 123/90.15
See application file for complete search history.

(56) References Cited

U.S. PATENT DOCUMENTS

| | | | | |
|---|---|---|---|---|
| 4,856,465 | A * | 8/1989 | Denz | F01L 1/34406 123/90.17 |
| 6,609,498 | B2 | 8/2003 | Mathews et al. | |
| 7,305,949 | B2 | 12/2007 | McCarthy et al. | |
| 2010/0095919 | A1* | 4/2010 | Myers | F01L 1/34 123/90.17 |
| 2010/0258069 | A1* | 10/2010 | Tada | F01L 1/022 123/90.17 |
| 2013/0180483 | A1* | 7/2013 | Weisser | F01L 1/344 123/90.15 |

* cited by examiner

*Primary Examiner* — Jorge L Leon, Jr.

(57) ABSTRACT

A camshaft phaser, including an axis of rotation; a target wheel including a first tab and a first timing feature; a stator arranged to receive rotational torque and including a plurality of radially inwardly extending protrusions; a rotor; and a spring. The rotor includes: a second timing feature; and, a plurality of radially outwardly extending protrusions circumferentially interleaved with the plurality of radially inwardly extending protrusions. The spring urges: the target wheel in a first circumferential direction with respect to the rotor; and the first timing feature into contact with the second timing feature. The first tab axially positions the target wheel within the camshaft phaser. The target wheel is arranged to interface with a position sensor to identify a rotational position of the rotor.

20 Claims, 16 Drawing Sheets

CAMSHAFT PHASER INCLUDING A TARGET WHEEL WITH A TIMING FEATURE

TECHNICAL FIELD

The present disclosure relates to a position sensor target wheel for a camshaft phaser with a timing feature to protect the position sensor target wheel from damage during assembly of the camshaft phaser.

BACKGROUND

A known camshaft phaser includes a position sensor target wheel connected by tabs to a spring for the camshaft phaser. The position sensor is used to detect a rotational position of the camshaft to enable proper phasing of the camshaft. During assembly of the camshaft phaser, a spring of the camshaft phaser rotates the tabs of the position sensor target wheel into contact with the rotor. The tabs can be damaged by the contact or by rough handling prior to installation of the spring, resulting in timing problems in the target wheel, which impacts the sensor's ability to properly read the camshaft position.

SUMMARY

According to aspects illustrated herein, there is provided a camshaft phaser, including: an axis of rotation; a target wheel including a first tab and a first timing feature; a stator arranged to receive rotational torque and including a plurality of radially inwardly extending protrusions; a rotor; and a spring. The rotor includes: a second timing feature; and, a plurality of radially outwardly extending protrusions circumferentially interleaved with the plurality of radially inwardly extending protrusions. The spring urges: the target wheel in a first circumferential direction with respect to the rotor; and the first timing feature into contact with the second timing feature. The first tab axially positions the target wheel within the camshaft phaser. The target wheel is arranged to interface with a position sensor to identify a rotational position of the rotor.

According to aspects illustrated herein, there is provided a camshaft phaser, including: an axis of rotation; a target wheel; a stator; a rotor; and a spring. The target wheel includes: a first tab, the first tab bounded in a first circumferential direction by a first surface of the target wheel; a second tab; and a first timing feature bounded in a second circumferential direction, opposite the first circumferential direction, by a second surface of the target wheel. The stator is arranged to receive rotational torque and includes a plurality of radially inwardly extending protrusions. The rotor includes: a second timing feature bounded in the second circumferential direction by a first surface of the rotor; a radial surface orthogonal to the axis of rotation; an indentation in the radial surface; and a plurality of radially outwardly extending protrusions circumferentially interleaved with the plurality of radially inwardly extending protrusions. The spring urges: the target wheel in the first circumferential direction with respect to the rotor; and the second surface of the target wheel and the first surface of the rotor into contact. The first tab is disposed in the indentation. The first tab and the second tab connect the target wheel to the spring. The target wheel is arranged to interface with a position sensor to identify a rotational position of the rotor.

According to aspects illustrated herein, there is provided a method of operating a camshaft phaser, the camshaft phaser including: a stator including a plurality of radially inwardly extending protrusions; a target wheel including a first timing feature, a first tab, and a second tab; a rotor including a second timing feature and a plurality of radially outwardly extending protrusions circumferentially interleaved with the plurality of radially inwardly extending protrusions; and a spring. The method comprises: connecting, with the first tab and the second tab, the target wheel to the spring; urging, with the spring, the target wheel in a first circumferential direction with respect to the rotor; contacting the second timing feature with the first timing feature; blocking rotation of the target wheel, with respect to the rotor and in the first circumferential direction; and identifying, with the target wheel and a position sensor, a rotational position of the rotor.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 16:
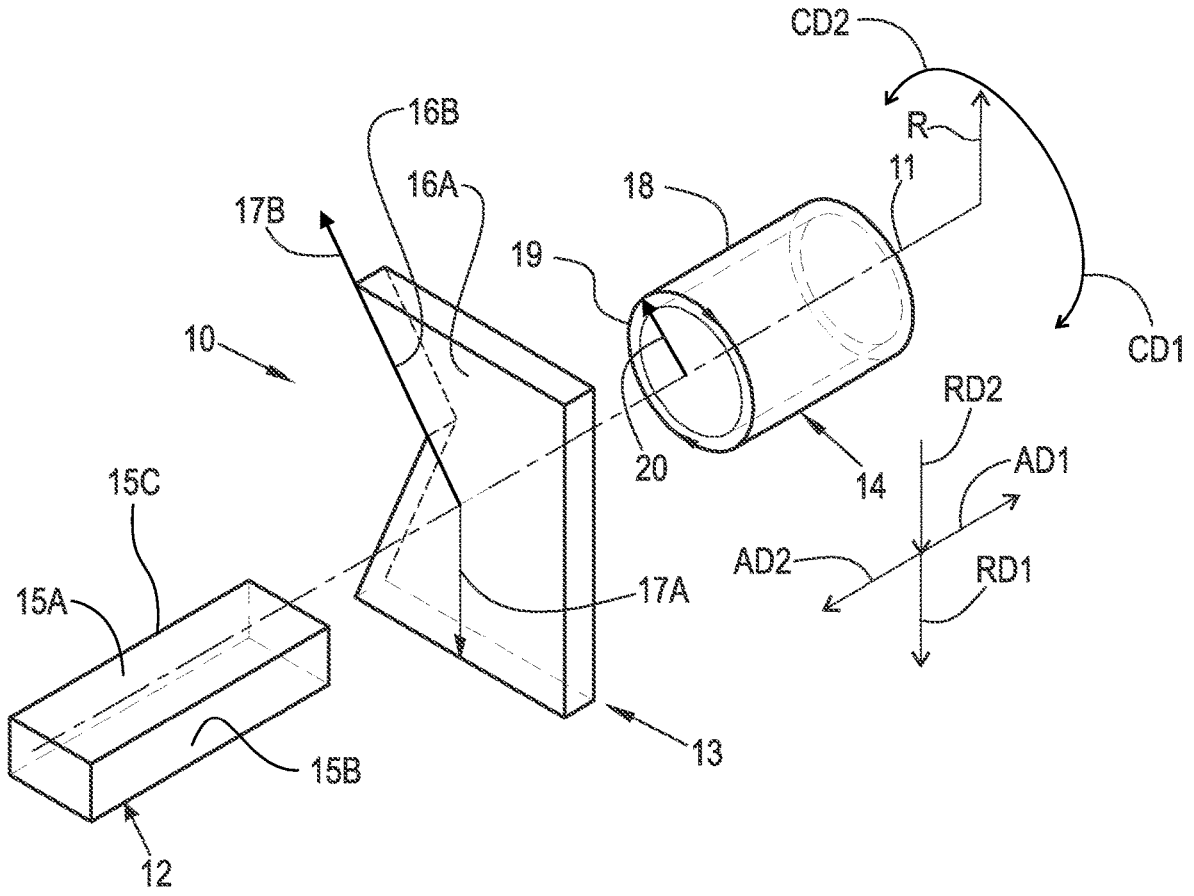
FIG. 16 is a perspective view of a cylindrical coordinate system demonstrating spatial terminology used in the present application.

FIG. 16 is a perspective view of cylindrical coordinate system 10 demonstrating spatial terminology used in the present application. The present application is at least partially described within the context of a cylindrical coordinate system. System 10 includes axis of rotation, or longitudinal axis, 11, used as the reference for the directional and spatial terms that follow. Opposite axial directions AD1 and AD2 are parallel to axis 11. Radial direction RD1 is orthogonal to axis 11 and away from axis 11. Radial direction RD2 is orthogonal to axis 11 and toward axis 11. Opposite circumferential directions CD1 and CD2 are defined by an endpoint of a particular radius R (orthogonal to axis 11) rotated about axis 11, for example clockwise and counterclockwise, respectively.

To clarify the spatial terminology, objects 12, 13, and 14 are used. As an example, an axial surface, such as surface 15A of object 12, is formed by a plane co-planar with axis 11. However, any planar surface parallel to axis 11 is an axial surface. For example, surface 15B, parallel to axis 11 also is an axial surface. An axial edge is formed by an edge, such as edge 15C, parallel to axis 11. A radial surface, such as surface 16A of object 13, is formed by a plane orthogonal to axis 11 and co-planar with a radius, for example, radius 17A. A radial edge is co-linear with a radius of axis 11. For example, edge 16B is co-linear with radius 17B. Surface 18 of object 14 forms a circumferential, or cylindrical, surface. For example, circumference 19, defined by radius 20, passes through surface 18.

Axial movement is in axial direction AD1 or AD2. Radial movement is in radial direction RD1 or RD2. Circumferential, or rotational, movement is in circumferential direction CD1 or CD2. The adverbs "axially," "radially," and "circumferentially" refer to movement or orientation parallel to axis 11, orthogonal to axis 11, and about axis 11, respectively. For example, an axially disposed surface or edge extends in direction AD1, a radially disposed surface or edge extends in direction RD1, and a circumferentially disposed surface or edge extends in direction CD1.

Figure 1:
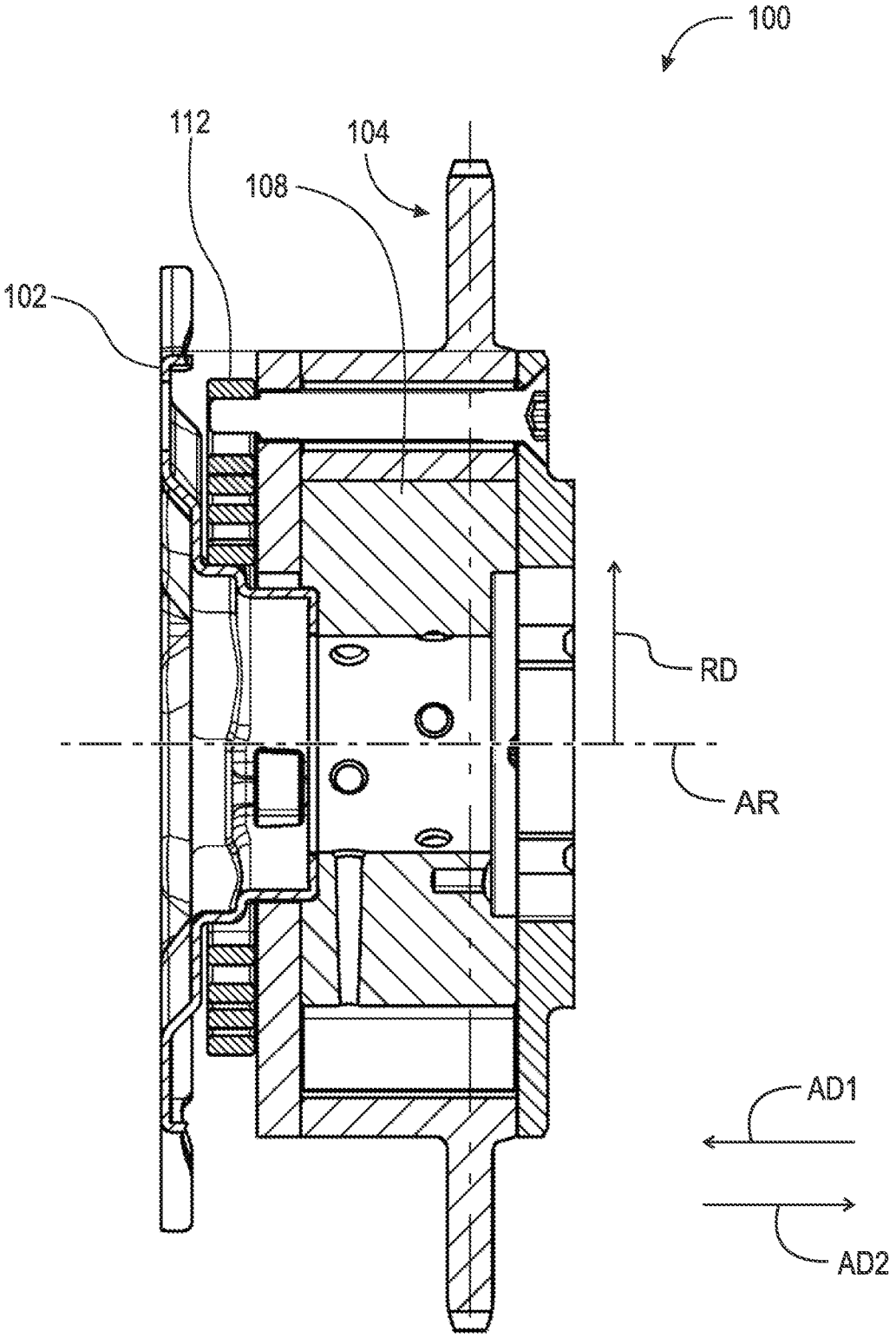
FIG. 1 is a cross-sectional view of a camshaft phaser including a target wheel with a timing feature.

FIG. 1 is a cross-sectional view of camshaft phaser 100 including a target wheel with a timing feature.

Figure 2:
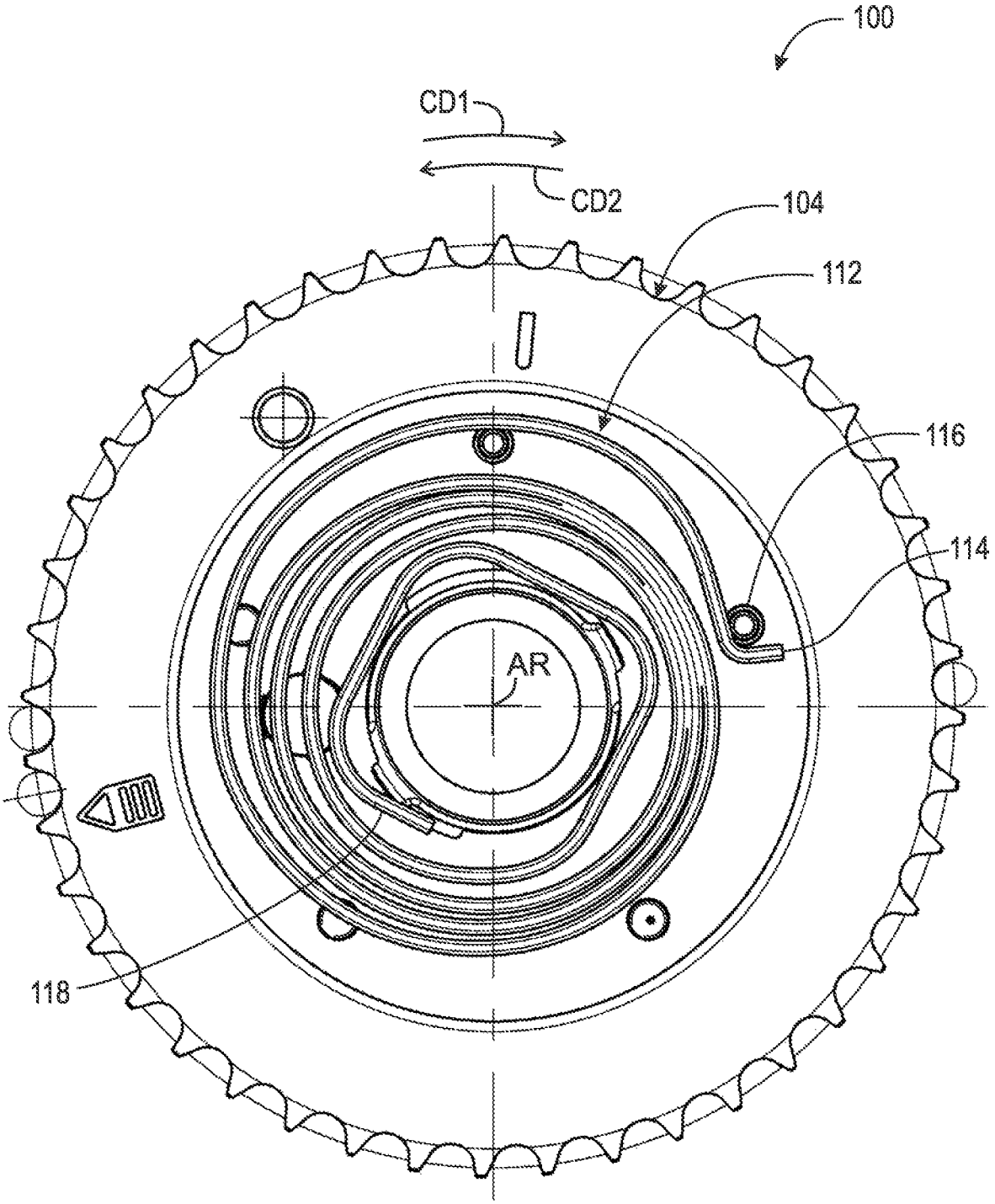
FIG. 2 is a front view of the camshaft phaser shown in FIG. 1 with the target wheel removed.

FIG. 2 is a front view of camshaft phaser 100 shown in FIG. 1 with the target wheel removed.

Figure 3:
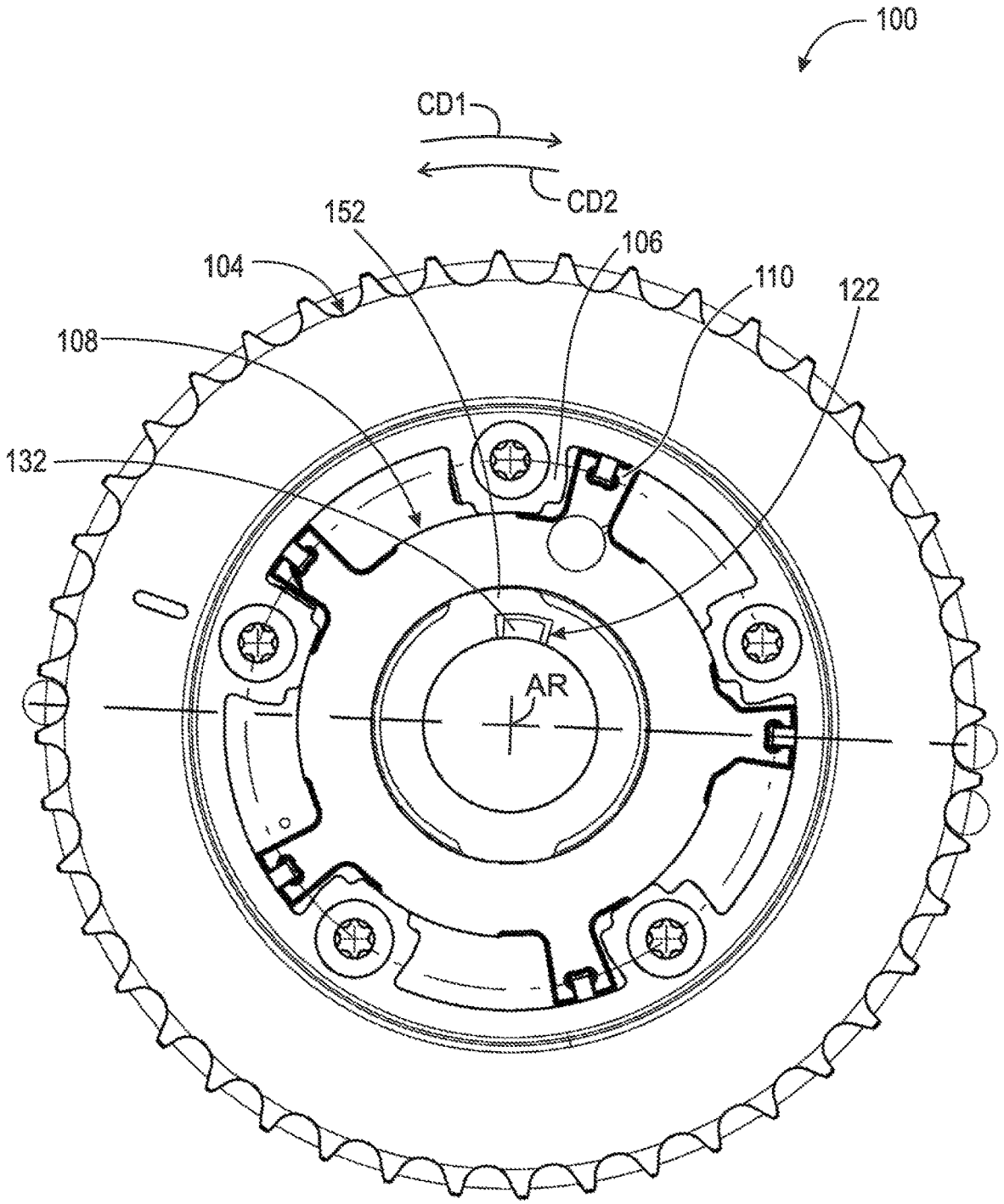
FIG. 3 is a front view of the camshaft phaser shown in FIG. 1 with an example rotor and with the target wheel and a spring removed.

FIG. 3 is a front view of camshaft phaser 100 shown in FIG. 1 with an example rotor and with the target wheel and a spring removed. The following should be viewed in light of FIGS. 1 through 3. Camshaft phaser 100 includes: axis of rotation AR; target wheel 102; stator 104 arranged to receive rotational torque and including radially inwardly extending protrusions 106; rotor 108 including radially outwardly extending protrusions 110 circumferentially interleaved with radially inwardly extending protrusions 106; and spring 112. Spring 112: includes end 114 fixed with respect to stator 104, for example via bolt 116 passing through stator 104; includes end 118 non-rotatably connected to target wheel 102; and urges target wheel 102 in circumferential direction CD1 with respect to rotor 108.

Figure 4:
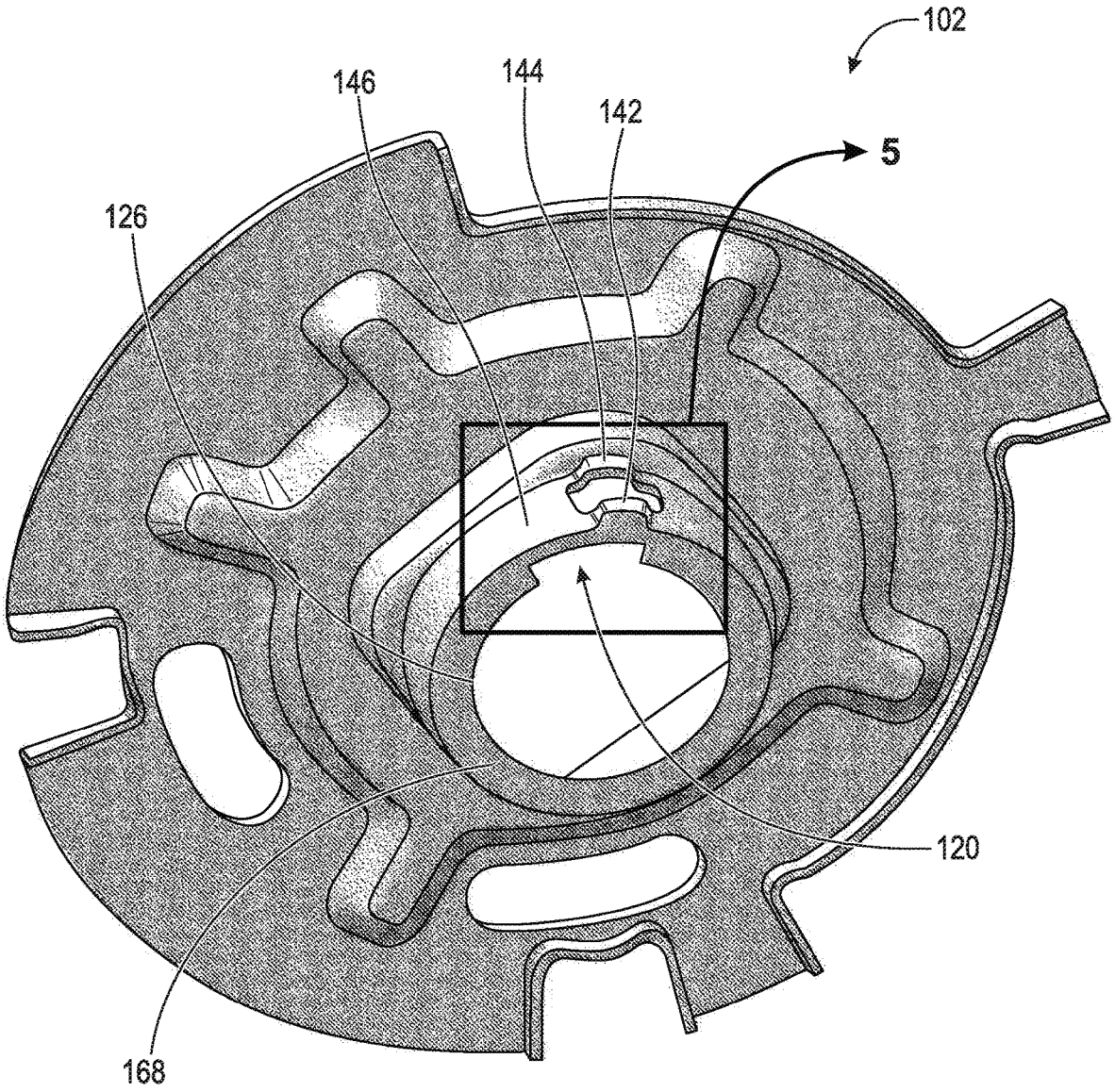
FIG. 4 is a back perspective view of an example of the target wheel shown in FIG. 1.

FIG. 4 is a back perspective view of an example of target wheel 102 shown in FIG. 1.

Figure 5:
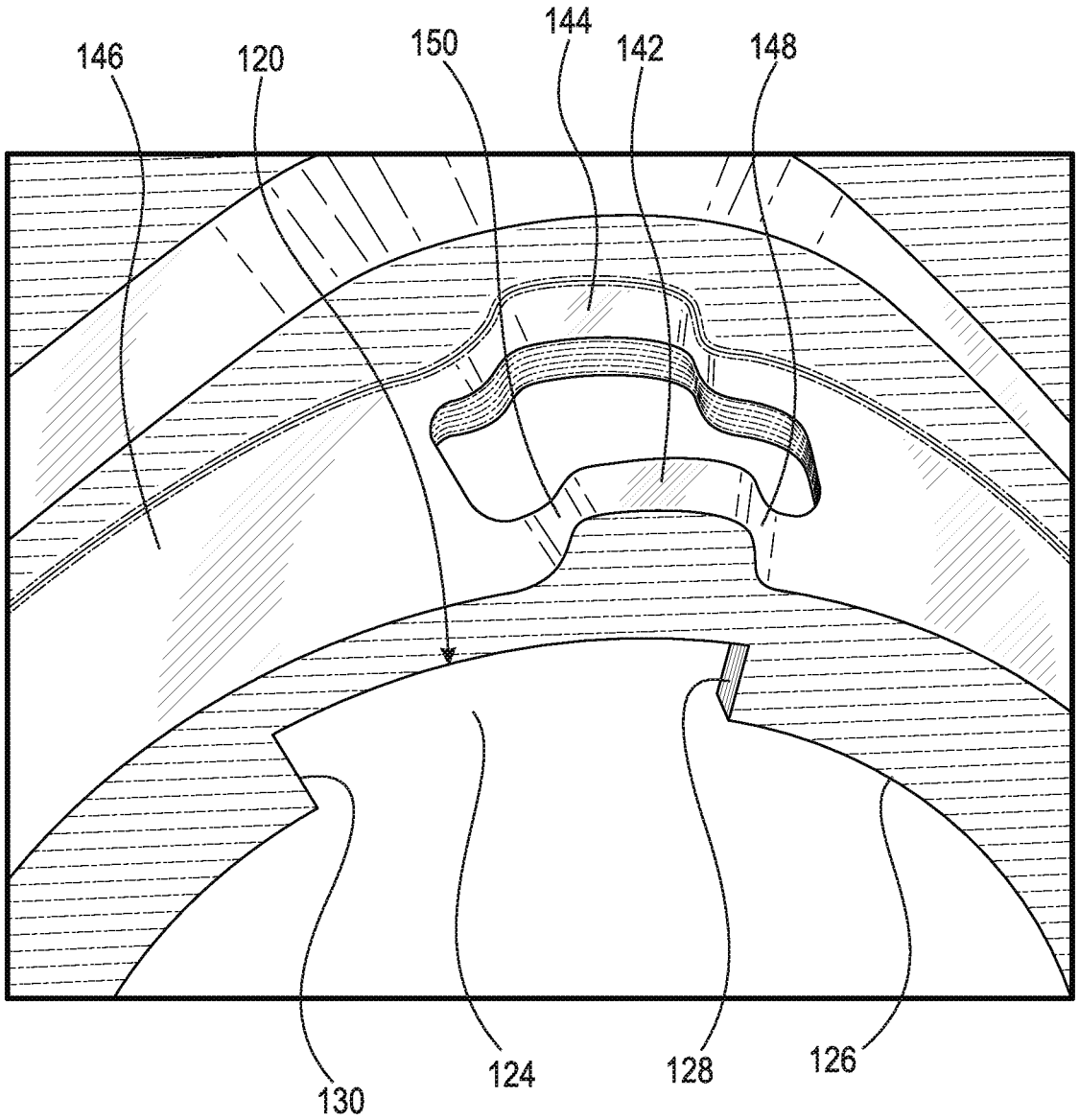
FIG. 5 is a detail of area 5 shown in FIG. 4.

FIG. 5 is a detail of area 5 shown in FIG. 4.

Figure 6:
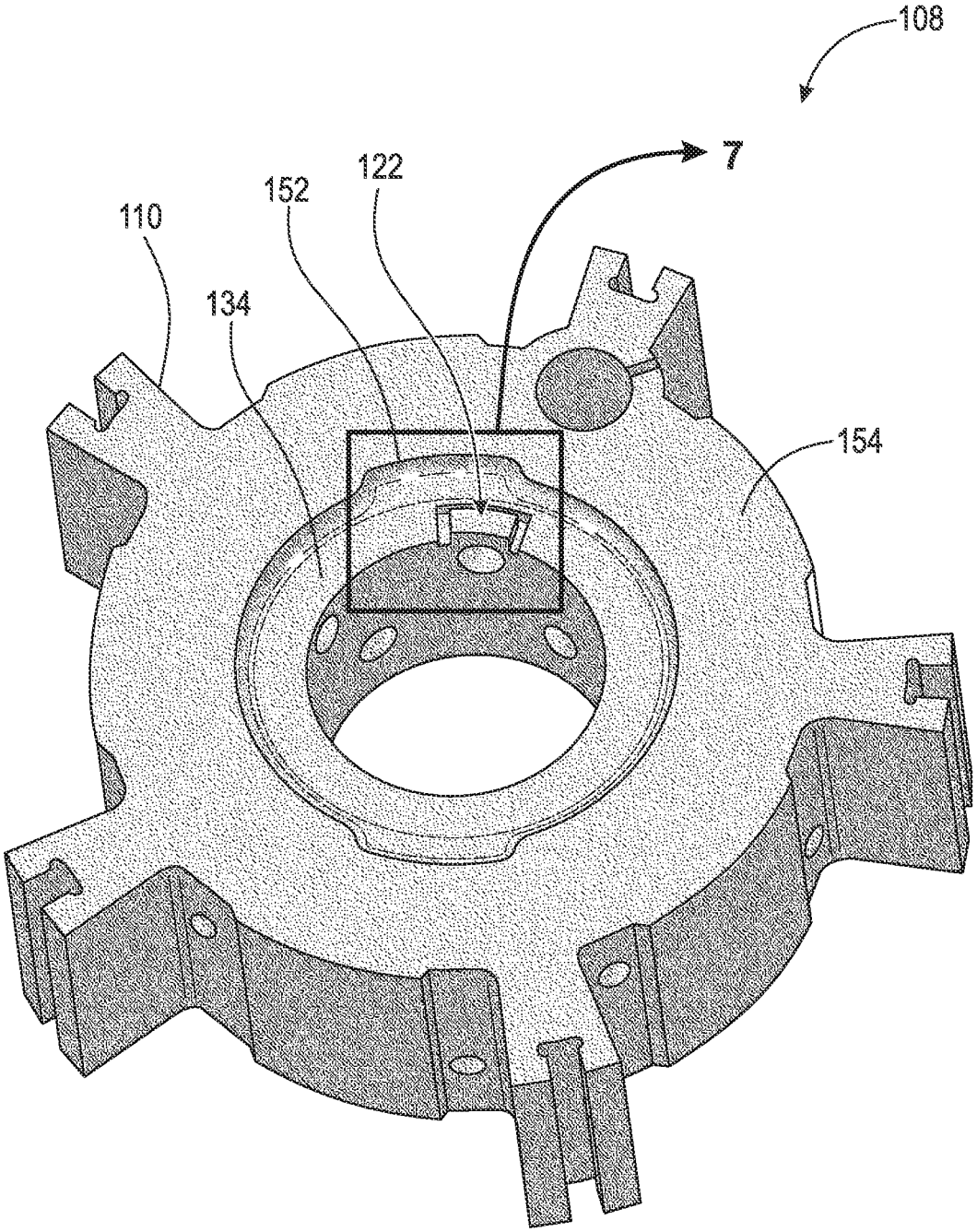
FIG. 6 is a front perspective view of an example of the rotor shown in FIG. 1.

FIG. 6 is a front perspective view of an example of rotor 108 shown in FIG. 1.

Figure 7:
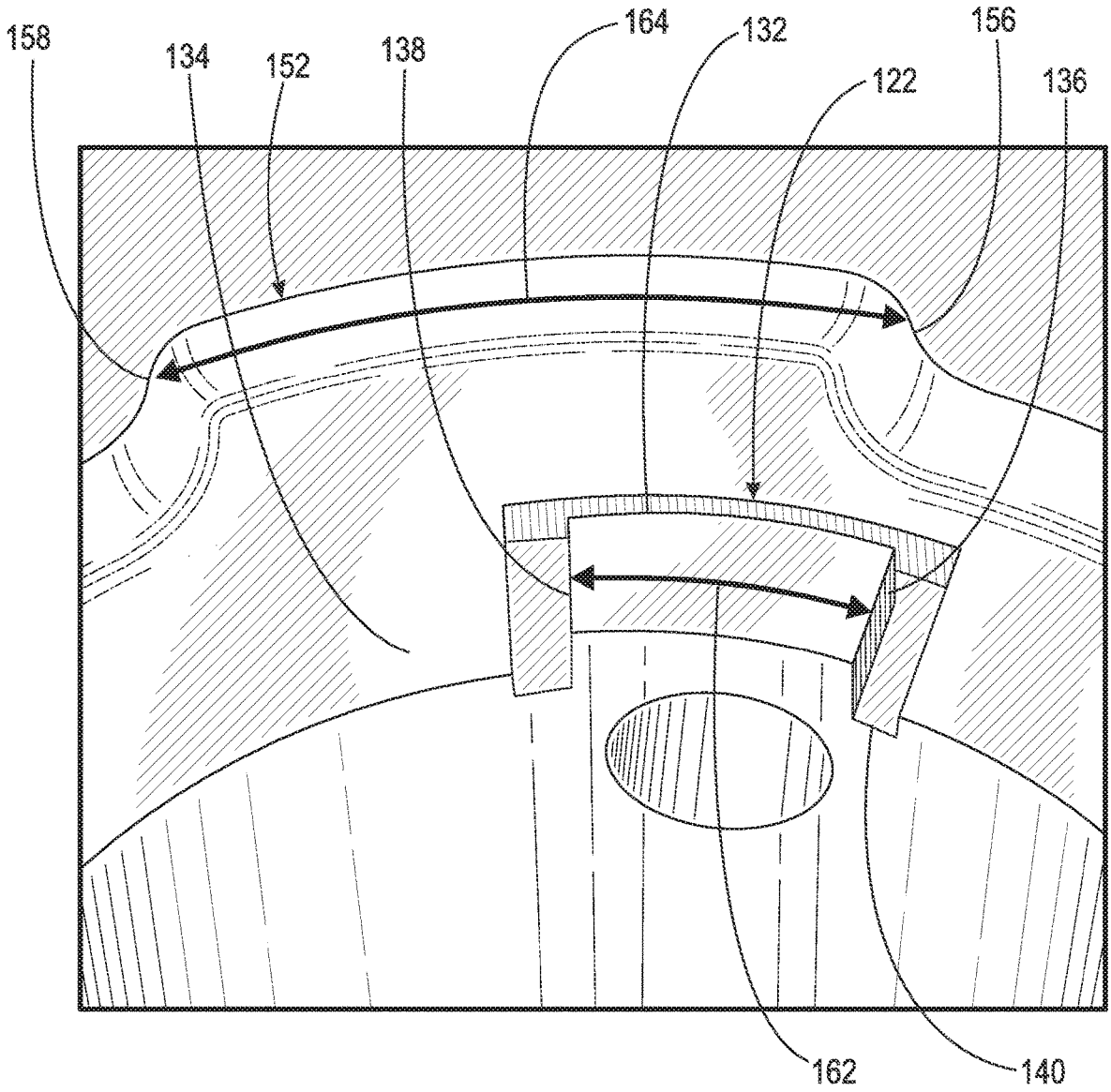
FIG. 7 is a detail of area 7 in FIG. 6.

FIG. 7 is a detail of area 7 in FIG. 6.

Figure 8:
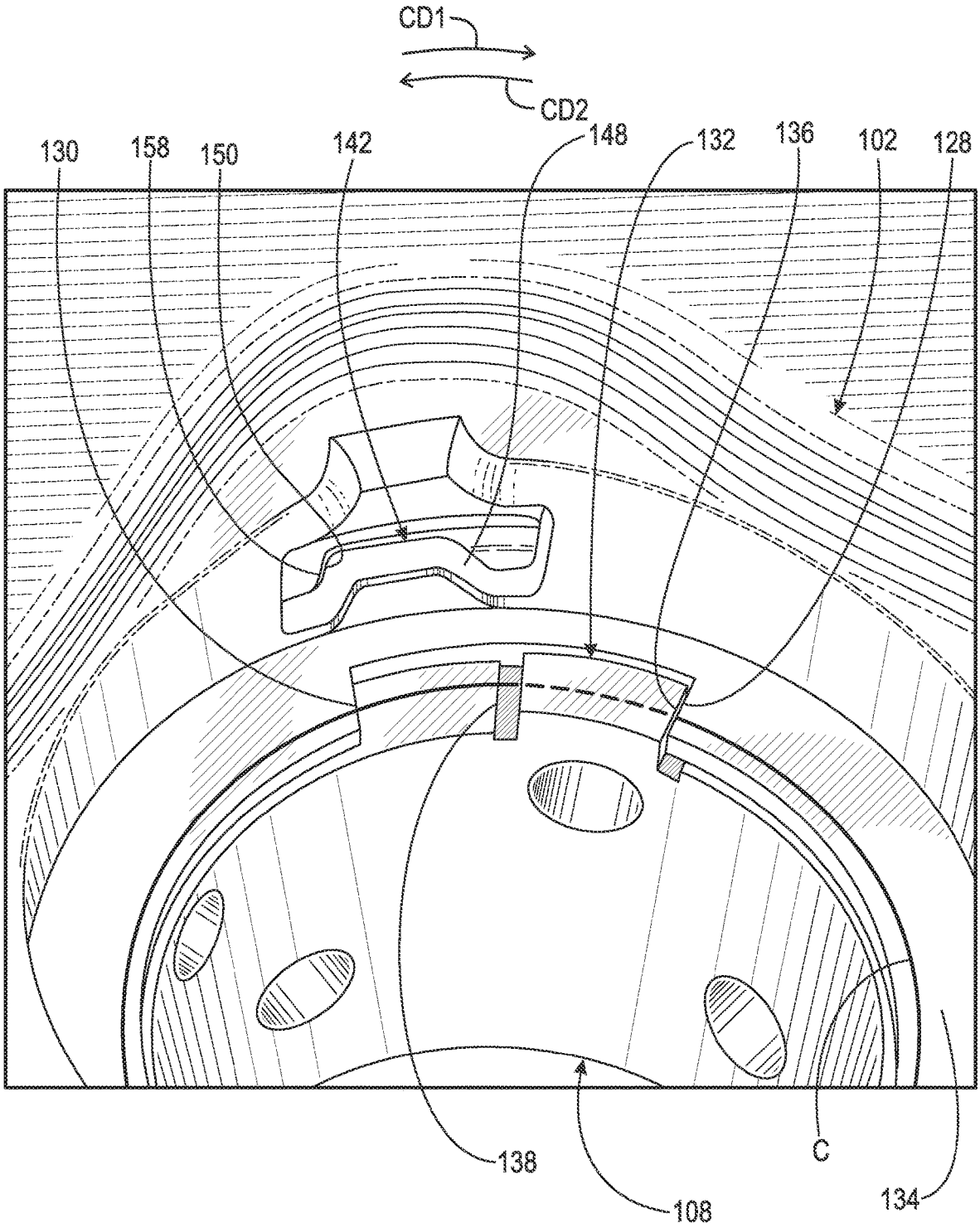
FIG. 8 is a front detail of the camshaft phaser shown in FIG. 1 with the target wheel and the rotor shown in FIGS. 4 through 7 in a pre-assembly configuration with the spring not yet installed.

FIG. 8 is a front detail of camshaft phaser 100 shown in FIG. 1 with target wheel 102 and rotor 108 shown in FIGS. 4 through 7 in a pre-assembly configuration with spring 112 not yet installed.

Figure 9:
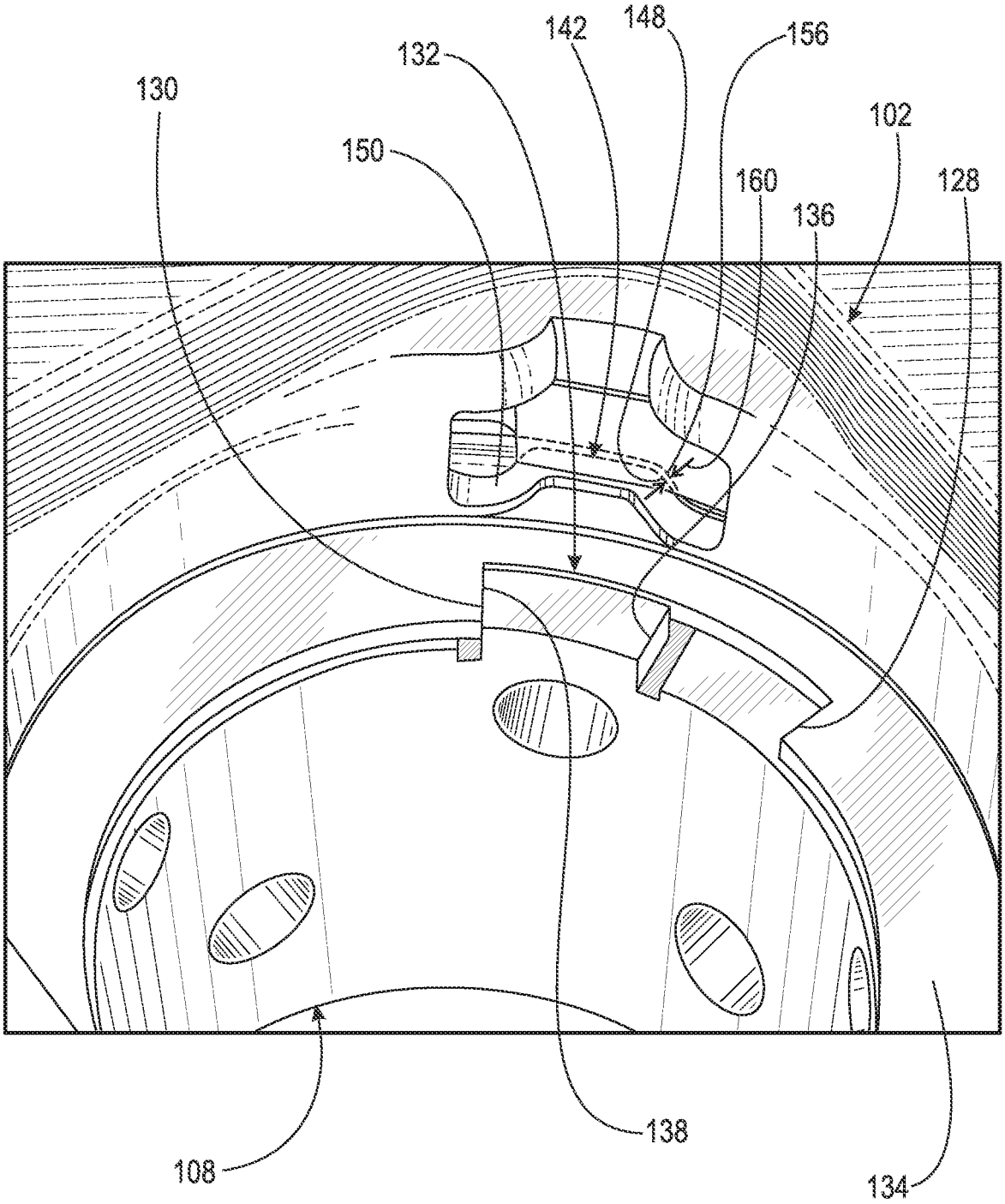
FIG. 9 is a front detail of the camshaft phaser shown in FIG. 1 with the target wheel and the rotor shown in FIG. 8 in a final assembly configuration.

FIG. 9 is a front detail of camshaft phaser 100 shown in FIG. 1 with target wheel 102, rotor 108, and spring 112 shown in FIG. 8 in a final assembly configuration. The following should be viewed in light of FIGS. 1 through 9. Target wheel 102 includes timing feature 120. Rotor 108 includes timing feature 122. As further described below, installing spring 112 in phaser 100 rotates target wheel 102 in direction CD1 with respect to rotor 108. That is, spring 112 rotates target wheel 102 from the position shown in FIG. 8 to the position shown in FIG. 9.

It is understood that in the discussion that follows, the structure and disposition of target wheel 102 and rotor 108 remain the same with the exception of timing feature 120 for target wheel 102, and timing feature 122 for rotor 108.

In the configuration of FIG. 8, contact between timing feature 120 and timing feature 122 blocks rotation of target wheel 102, with respect to rotor 108, in circumferential direction CD2, opposite direction CD1. As further described below, in the final assembly configuration of FIG. 9, contact between timing feature 120 and timing feature 122 blocks rotation of target wheel 102, with respect to rotor 108, in circumferential direction CD1.

In the example of FIGS. 4 through 9, timing feature 120 includes slot, or indentation 124 in radially inner surface 126 of target wheel 102. Indentation 124 is bounded by surface 128 of target wheel 102 in circumferential direction CD1 and by surface 130 of target wheel 102 in circumferential direction CD2. In the example of FIGS. 4 through 9, timing feature 122 includes protrusion 132 extending past radial surface 134, orthogonal to axis of rotation AR, of rotor 108 in axial direction AD1. Protrusion 132 is bounded by surface 136 in circumferential direction CD1 and by surface 138 in circumferential direction CD2. Circle C, centered about axis AR, lies upon surface 134 and passes through protrusion 132. In an example embodiment, protrusion 132 is bounded in radially outward direction RD and in directions CD1 and CD2 by groove 140 in surface 134. Thus, surfaces 128 and 130 form circumferential ends of timing feature 120, and surfaces 136 and 138 form circumferential ends of timing feature 122. By an element "bounded" in a particular circumferential direction by a surface, we mean that the surface forms a boundary of the element facing at least partially in the particular circumferential direction.

Target wheel 102 includes tabs 142 and 144. Tabs 142 and 144 extend radially outwardly from radially outer surface 146 of target wheel 102. Tabs 142 and 144 connect target wheel 102 to spring 112 and fix an axial position of target wheel 102 with respect to rotor 108. Tabs 142 and 144 are located radially outwardly of timing features 120 and 122. Tab 142 is bounded by surface 148 in circumferential direction CD1 and by surface 150 in circumferential direction CD2. Thus, surfaces 148 and 150 form circumferential ends of tab 142.

Rotor 108 includes indentation 152 in radial surface 154, orthogonal to axis of rotation AR, of rotor 108. Indentation 152 is bounded by surface 156 in circumferential direction CD1 and by surface 158 in circumferential direction CD2. At least a portion of tab 142 is disposed in indentation 152.

In the circumferential position of target wheel 102, with respect to rotor 108, shown in FIG. 8, contact between timing feature 120 and timing feature 122 blocks rotation of target wheel 102, with respect to rotor 108, in circumferential direction CD2. In the example of FIG. 8: surfaces 128 and 136 are in contact; surfaces 150 and 158 are in contact; and contact between surface 128 and 136 prevents surface 150 from impinging on surface 158 further in direction CD2, protecting tab 142 from damage from surface 158. In an example embodiment, (not shown) in the circumferential position of target wheel 102, with respect to rotor 108, shown in FIG. 8: surfaces 128 and 136 are in contact; and a gap in direction CD1 is present between surfaces 150 and 158.

In the circumferential position of example target wheel 102, with respect to example rotor 108, shown in FIG. 9: contact between timing feature 120 and timing feature 122 blocks rotation of target wheel 102, with respect to rotor 108, in circumferential direction CD1. In particular: surface 138 is in contact with surface 130; and gap 160 is present between surfaces 148 and 156 in direction CD1. As further discussed below, gap 160 prevents damage to tab 142 from rotation of target plate 102, in direction CD1, into contact with rotor 108.

Figure 10:
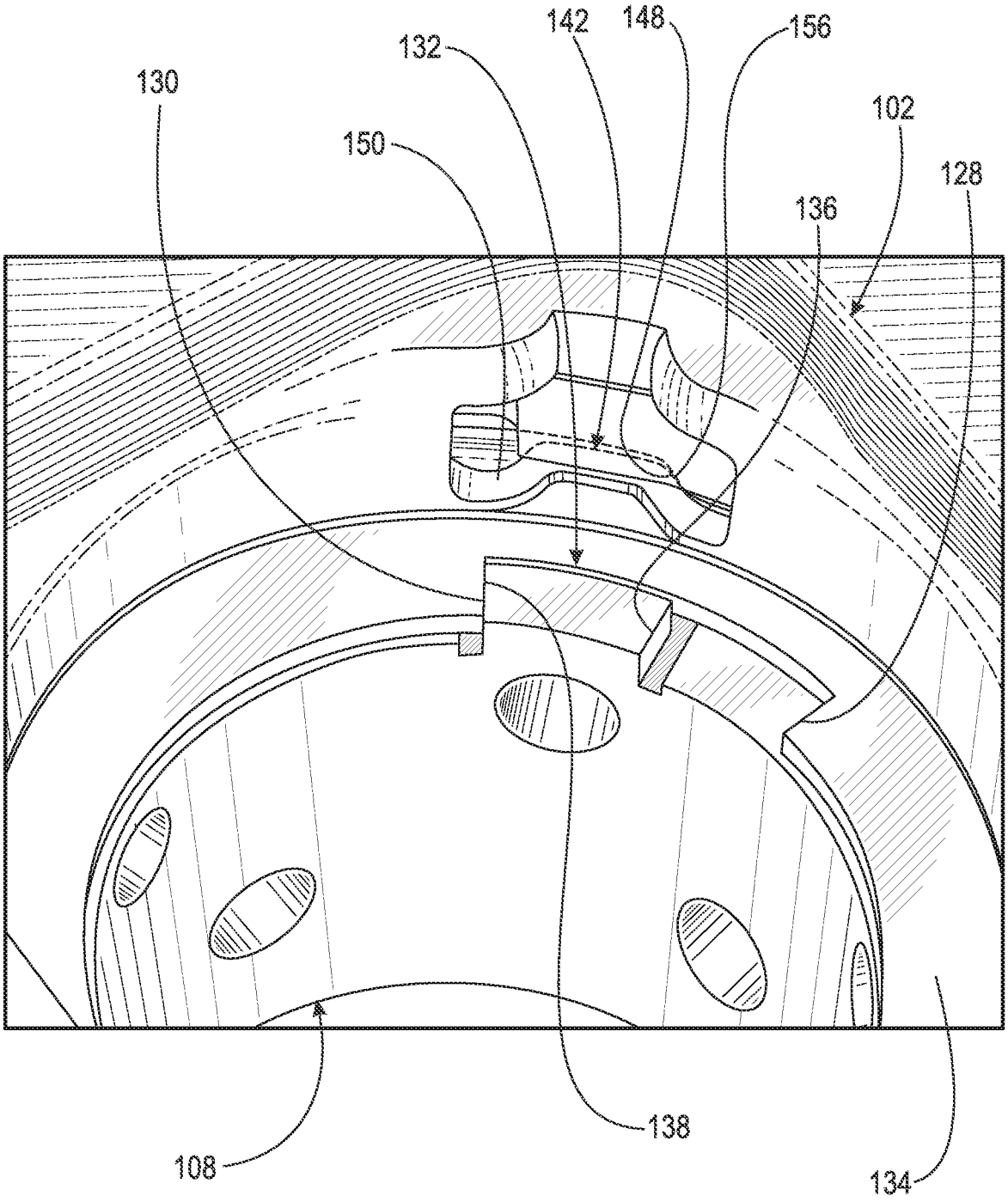
FIG. 10 is a front detail of the camshaft phaser shown in FIG. 1 with the target wheel and the rotor shown in FIG. 8 in a final assembly configuration.

FIG. 10 is a front detail of camshaft phaser 100 shown in FIG. 1 with target wheel 102, rotor 108, and spring 112 shown in FIG. 8 in a final assembly configuration. In an example embodiment shown in FIG. 10: surface 138 is in contact with surface 130; surfaces 148 and 156 are in contact; and contact between surface 138 and 130 prevents surface 148 from impinging on surface 156 further in direction CD1, protecting tab 142 from damage from surface 156.

Surfaces 136 and 138 are separated by distance 162 in direction CD1. Surfaces 156 and 158 are separated by distance 164 in direction CD1. In an example embodiment, a maximum value for distance 162 is less than a minimum value for distance 164.

Figure 11:
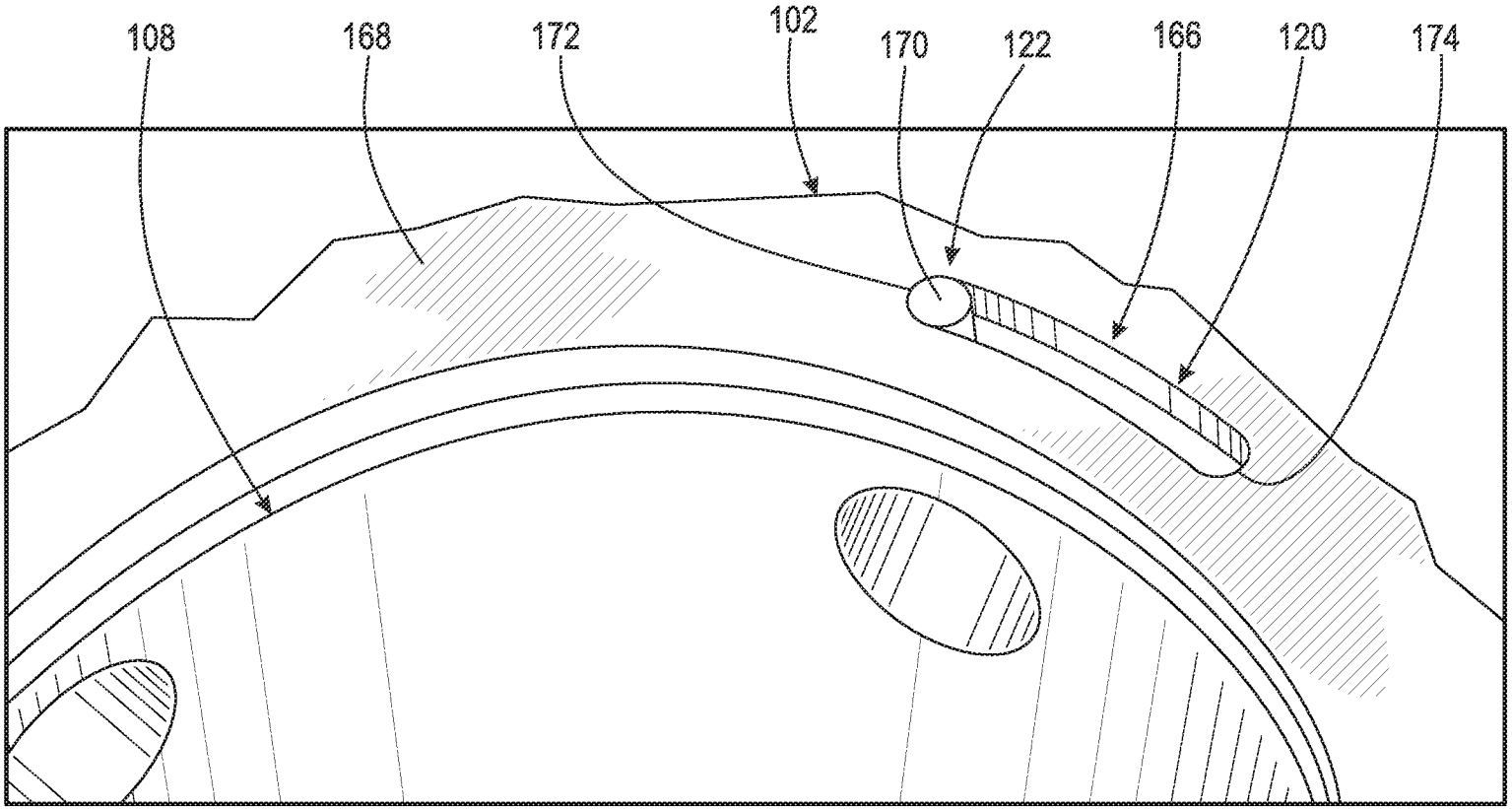
FIG. 11 is a front detail of an example target wheel and an example rotor shown in FIG. 1 in a final assembly configuration with the spring installed.

FIG. 11 is a front detail of example target wheel 102 and example rotor 108 shown in FIG. 1 in a final assembly configuration with spring 112 installed. In the example of FIG. 11: timing feature 120 includes slot 166 in radial surface 168, orthogonal to axis of rotation AR, of target wheel 102; and timing feature 122 includes pin 170 fixedly connected to surface 134 and located in slot 166. Pin 170 is in contact with end 172 of slot 166 to block rotation of target wheel 102 in direction CD1. Pin 170 contacts end 174 of slot 166 to block rotation of target wheel 102 in direction CD2, preventing damage to tab 142 through contact with surface 156. Contact of pin 170 with end 174 either: creates a gap in direction CD1 between surfaces 148 and 156; or enables contact of surface 148 with surface 156 while preventing tab 142 from impinging further on rotor 108 in direction CD1. Tab 142 is not shown in FIG. 11; however: the configurations of tab 142 and rotor 108 in FIGS. 9 and 10 are applicable to FIG. 11.

Figure 12:
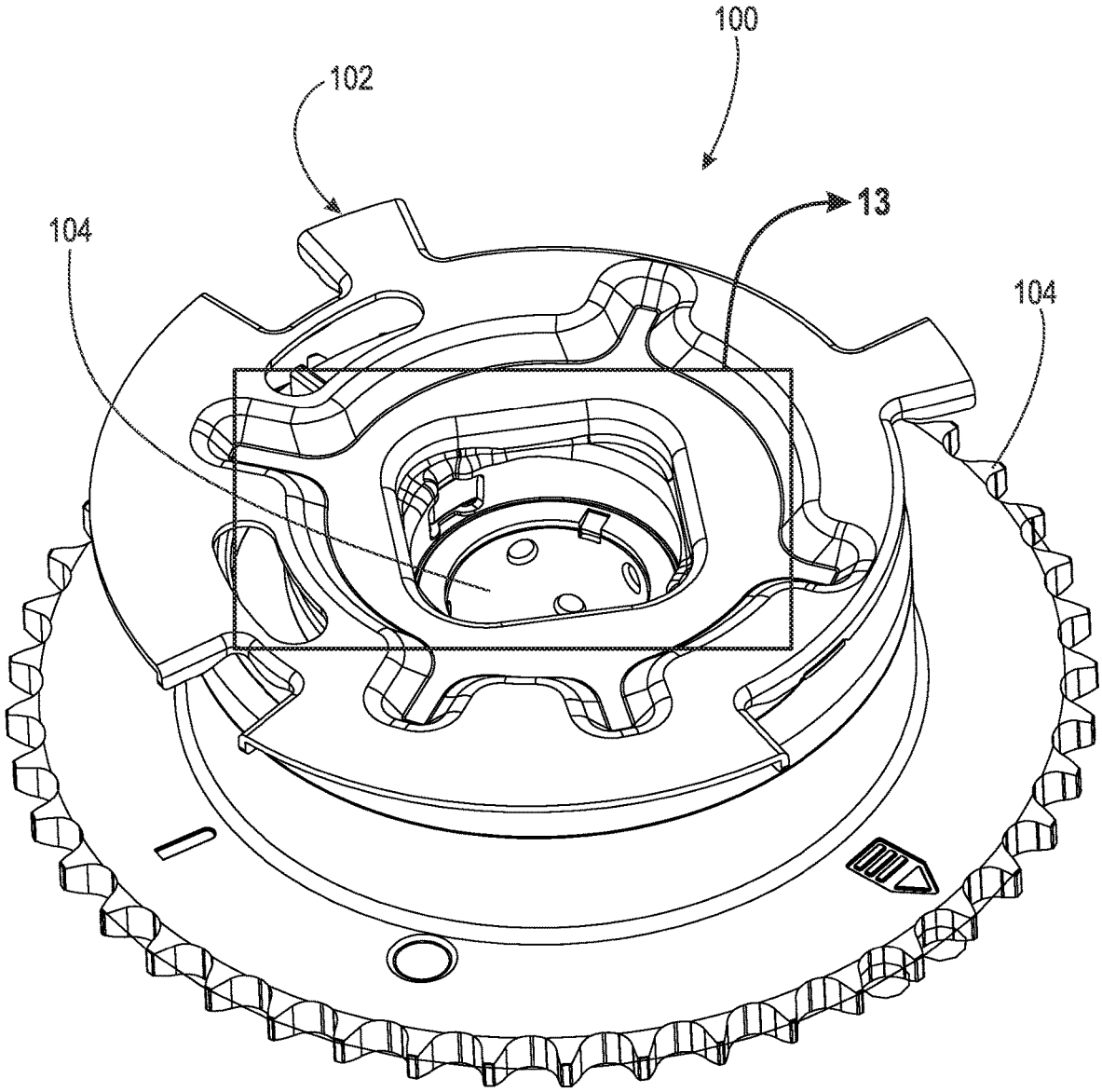
FIG. 12 is a front perspective view of the camshaft phaser shown in FIG. 1 including an example target wheel and an example rotor in a final assembly configuration with the spring installed.

FIG. 12 is a front perspective view of camshaft phaser 100 shown in FIG. 1 including example target wheel 102 and example rotor 108 in a final assembly configuration with spring 112 installed.

Figure 13:
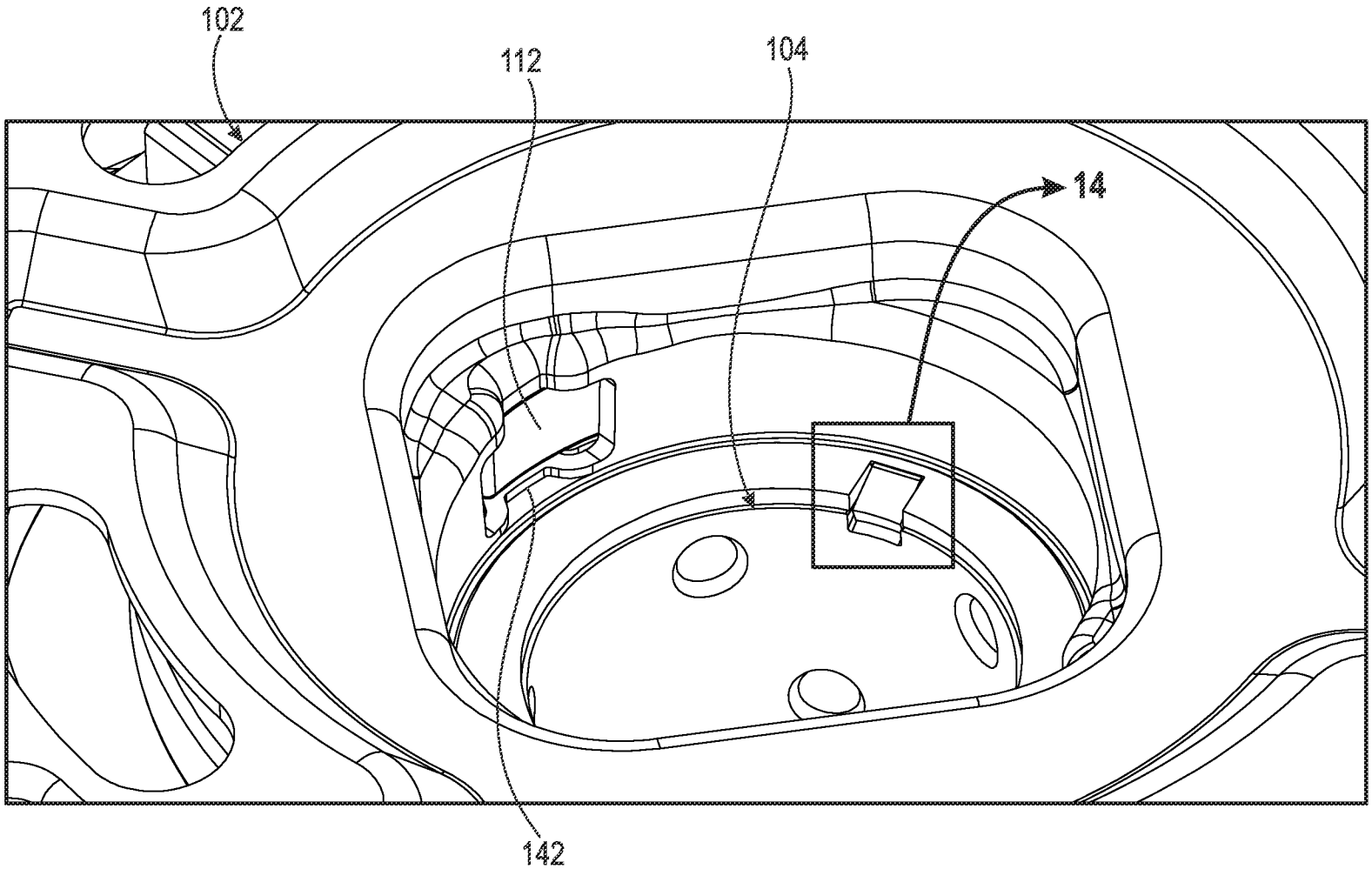
FIG. 13 is a detail of area 13 in FIG. 12.

FIG. 13 is a detail of area 13 in FIG. 12.

Figure 14:
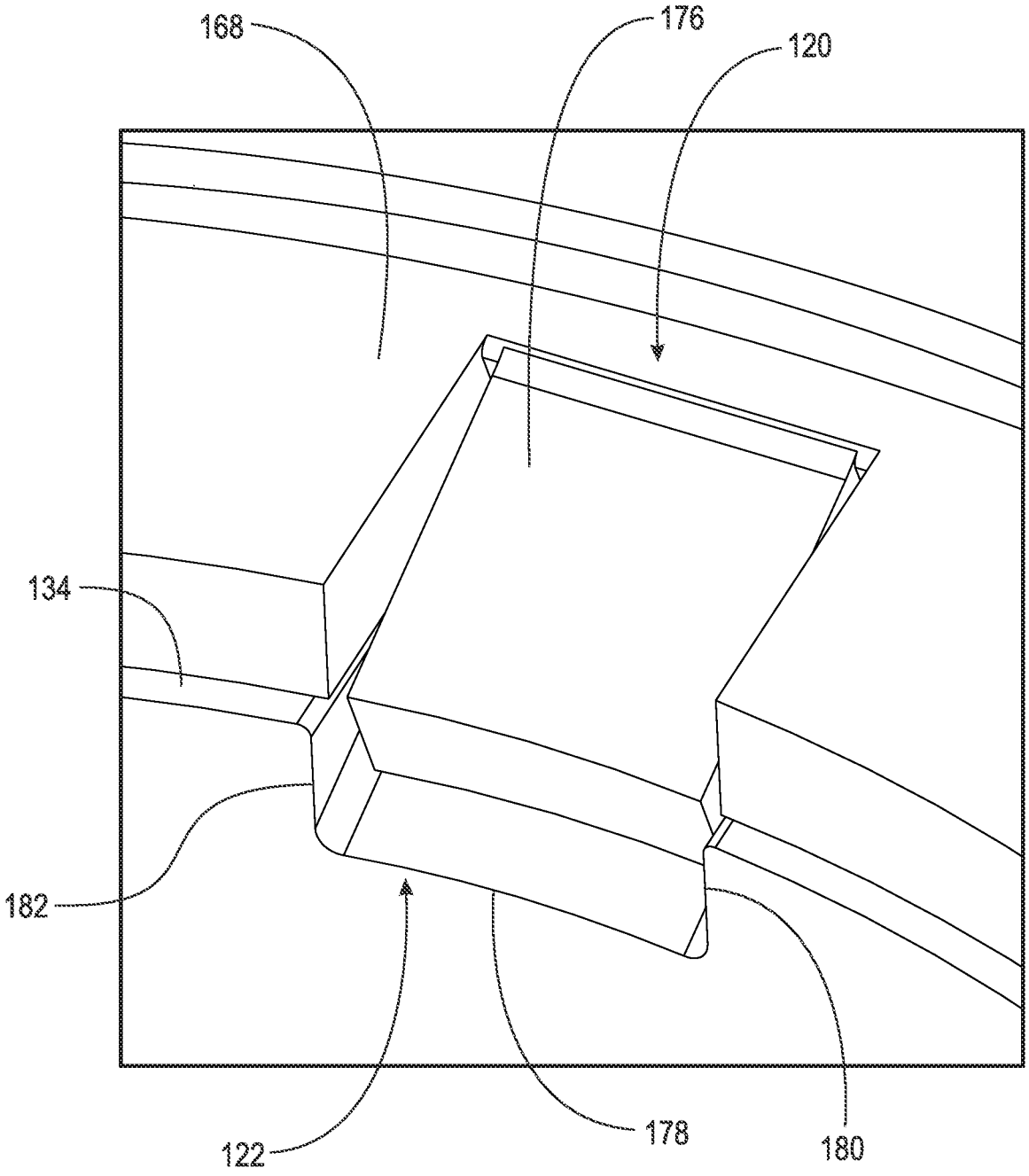
FIG. 14 is a detail of area 14 in FIG. 13.

FIG. 14 is a detail of area 14 in FIG. 13. The following should be viewed in light of FIGS. 12 through 14. In the example of FIGS. 12 through 14: timing feature 120 includes tab 176 extending from surface 168; and timing feature 122 includes indentation 178 in surface 134. Indentation 178 is bounded in directions CD1 and CD2 by surfaces 180 and 182, respectively. At least a portion of tab 176 is disposed in indentation 178. Contact of tab 176 with surfaces 180 and 182 blocks rotation of target wheel 102, with respect to rotor 108, in directions CD1 and CD2, respectively, to protect tab 142 from damage due to contact with rotor 108. Tab 142 is not shown in FIG. 12; however: the configurations of tab 142 and rotor 108 in FIGS. 9 and 10 are applicable to FIG. 12.

During pre-assembly of phaser 100, it is desirable to prevent contact, or control contact, between tab 142 and rotor 108, for example during storage, shipping, or handling of phaser 100. When spring 112 is installed in phaser 100, it is desirable to prevent contact, or control contact, between tab 142 and rotor 108 due to force applied by spring 112 to target wheel 102 in direction CD1. As shown above, timing features 120 and 122 prevent or control contact between tab 142 and rotor 108 in directions CD1 and CD2, preventing damage to tab 142.

Since tabs 142 and 144 are not required to withstand force from spring 112, the structure of target wheel 102 can be focused on the primary function of tabs 142 and 144, axially bracketing spring 112 and positioning target wheel 102. Thus, tabs 142 and 144 are less robust than would be necessary if contact between tab 142 and rotor 108 was not controlled, enabling target wheel 102 to be manufactured by stamping thin sheet metal. The use of thin sheet metal for the fabrication of target wheel 102 results in: a savings in material; and a reduction of press forces in the fabrication of target wheel 102, which in turn reduces the cost and complexity of fabricating target wheel 102. In addition, using thin metal for target wheel 102 lowers rotating inertia in an engine including phaser 100.

Figure 15:
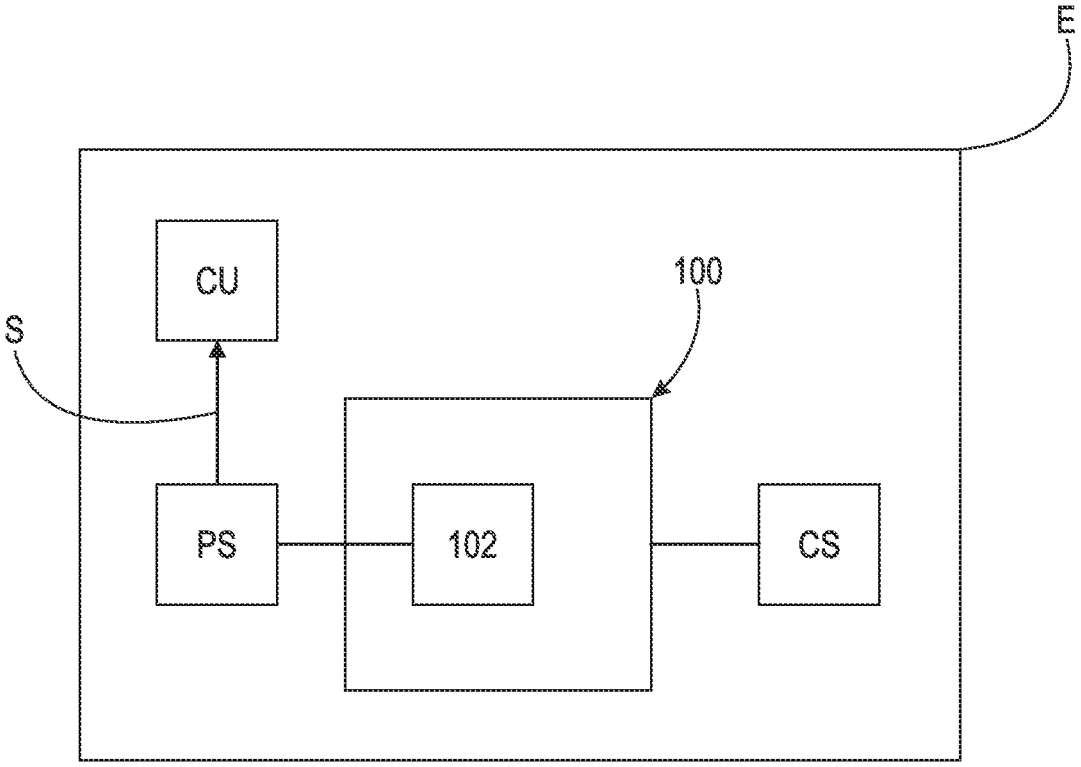
FIG. 15 is a schematic block diagram showing the camshaft phaser, shown in FIG. 1, and a position sensor assembly.

FIG. 15 is a schematic block diagram showing camshaft phaser 100, shown in FIG. 1, and a position sensor assembly. As is known in the art, target wheel 102 is arranged to interface with position sensor PS to detect a rotational position of camshaft CS. For example, sensor PS sends signal S to control unit CU for engine E including camshaft phaser 100.

The following should be viewed in light of FIGS. 1 through 15. The following describes a method of operating camshaft phaser 100. A first step connects, with tab 142 and tab 144, target wheel 102 to spring 112. A second step urges, with spring 112, target wheel 102 in circumferential direction CD1 with respect to rotor 108. A third step contacts timing feature 122 with timing feature 120. A fourth step blocks rotation of target wheel 102, with respect to rotor 108 in circumferential direction CD1. A fifth step identifies, with target wheel 102 and position sensor PS, a rotational position of rotor 108.

In an example embodiment, contacting timing feature 122 with timing feature 120 includes: contacting surface 138 with surface 130 and avoiding contact between surface 148 and surface 156; or contacting pin 170 with end 172 and avoiding contact between surface 148 and surface 156; or contacting tab 176 with surface 180 and avoiding contact between surface 148 and surface 156.

In an example embodiment, contacting timing feature 122 with timing feature 120 includes: contacting surface 138 with surface 130 and contacting surface 148 with surface 156; or contacting pin 170 with end 172 and contacting surface 148 with surface 156; or contacting tab 176 with surface 180 and contacting surface 148 with surface 156.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

10 cylindrical system
11 axis of rotation
AD1 axial direction
AD2 axial direction
RD1 radial direction
RD2 radial direction
CD1 circumferential direction
CD2 circumferential direction
R radius
12 object
13 object
14 object
15A surface
15B surface
15C edge
16A surface
16B edge
17A radius
17B radius
18 surface
19 circumference
20 radius
AR axis of rotation
C circle
CS camshaft
CU control unit
E engine
PS position sensor
S signal
100 camshaft phaser
102 target wheel
104 stator
106 protrusion, stator
108 rotor
110 protrusion, rotor
112 spring
114 end, spring
116 bolt
118 end, spring
120 timing feature, target wheel
122 timing feature, rotor
124 slot or indentation, target wheel
126 surface, target wheel
128 surface, target wheel
130 surface, target wheel
132 protrusion, rotor
134 radial surface, rotor
136 surface, protrusion
138 surface, protrusion
140 groove, rotor
142 tab, target wheel
144 tab, target wheel
146 radial surface, target wheel
148 surface, tab
150 surface, tab
152 indentation, rotor
154 radial surface, rotor
156 surface, indentation
158 surface, indentation
160 gap
162 distance
164 distance
166 slot, target wheel
168 radial surface, target wheel
170 pin, rotor
172 end, slot 166
174 end, slot 166
176 tab, target wheel
178 indent, rotor
180 surface, indentation
182 surface, indentation

The invention claimed is:

1. A camshaft phaser, comprising:
an axis of rotation;
a target wheel including:
a first tab; and,
a first timing feature;
a stator arranged to receive rotational torque and including a plurality of radially inwardly extending protrusions;
a rotor including:
a second timing feature; and,
a plurality of radially outwardly extending protrusions circumferentially interleaved with the plurality of radially inwardly extending protrusions; and,
a spring urging:
the target wheel in a first circumferential direction with respect to the rotor; and,
the first timing feature into contact with the second timing feature, wherein:
the first tab axially positions the target wheel within the camshaft phaser; and,
the target wheel is arranged to interface with a position sensor.

2. The camshaft phaser of claim 1, wherein:
the target wheel further includes a radially outer surface; and,
the first tab extends radially outwardly from the radially outer surface.

3. The camshaft phaser of claim 1, wherein the first tab is located radially outwardly from the first timing feature and the second timing feature.

4. The camshaft phaser of claim 1, wherein:
the first timing feature is bounded in a second circumferential direction, opposite the first circumferential direction, by a surface of the target wheel;
the second timing feature is bounded in the second circumferential direction by a first surface of the rotor; and,
the spring urges the surface of the target wheel into contact with the first surface of the rotor.

5. The camshaft phaser of claim 4, wherein:
the rotor further includes:
a first axial end surface orthogonal to the axis of rotation; and,
an indentation in the first axial end surface;
the indentation is bounded in the first circumferential direction by a second surface of the rotor;
the first tab:
is bounded, in the first circumferential direction, by a surface of the first tab; and, is disposed in the indentation; and, the surface of the first tab is free of contact with the second surface of the rotor.

6. The camshaft phaser of claim 5, wherein:

the target wheel further includes a radially inner surface;

the first timing feature includes an indentation in the radially inner surface;

the rotor further includes a second axial end surface orthogonal to the axis of rotation;

the second timing feature includes a protrusion extending past the second axial end surface in a first axial direction; and, a circle, centered about the axis of rotation:

is co-planar with an axial end surface of the target wheel; and, passes through the protrusion of the second timing feature.

7. The camshaft phaser of claim 5, wherein:

the target wheel further includes an axial end surface orthogonal to the axis of rotation;

the first timing feature includes a slot, in the axial end surface of the target wheel, extending in the first circumferential direction;

the rotor further includes a second axial end surface orthogonal to the axis of rotation;

the second timing feature includes a pin:

fixedly connected to the second axial end surface of the rotor; and, disposed in the slot of the first timing feature.

8. The camshaft phaser of claim 5, wherein:

the target wheel further includes an axial end surface orthogonal to the axis of rotation;

the first timing feature includes a tab extending from the axial end surface of the target wheel;

the rotor further includes a second axial end surface orthogonal to the axis of rotation;

the second timing feature includes an indentation in the second axial end surface of the rotor; and, at least a portion of the tab is located in the indentation of the second timing feature.

9. The camshaft phaser of claim 4, wherein:

the rotor further includes:

a first axial end surface orthogonal to the axis of rotation; and, an indentation in the first axial end surface of the rotor;

the indentation is bounded in the first circumferential direction by a second surface of the rotor;

the first tab:

is bounded, in the first circumferential direction, by a surface of the first tab; and, is disposed in the indentation of the rotor; and, the surface of the first tab is in contact with the second surface of the rotor.

10. The camshaft phaser of claim 9, wherein:

the target wheel further includes a radially inner surface;

the first timing feature includes an indentation in the radially inner surface;

the rotor further includes a second axial end surface orthogonal to the axis of rotation;

the second timing feature includes a protrusion extending past the second axial end surface of the rotor in a first axial direction; and, a circle, centered about the axis of rotation:

is co-planar with a axial end surface of the target wheel; and, passes through the protrusion of the second timing feature.

11. The camshaft phaser of claim 9, wherein:

the target wheel further includes an axial end surface orthogonal to the axis of rotation;

the first timing feature includes a slot, in the axial end surface of the target wheel, extending in the first circumferential direction;

the rotor further includes a second axial end surface orthogonal to the axis of rotation;

the second timing feature includes a pin:

fixedly connected to the second axial end surface of the rotor; and, disposed in the slot of the first timing feature.

12. The camshaft phaser of claim 9, wherein:

the target wheel further includes an axial end surface orthogonal to the axis of rotation;

the first timing feature includes a tab extending from the axial end surface of the target wheel;

the rotor further includes a second axial end surface orthogonal to the axis of rotation;

the second timing feature includes an indentation in the second axial end surface of the rotor; and, at least a portion of the tab is located in the indentation of the second timing feature.

13. The camshaft phaser of claim 1, wherein:

the rotor further includes:

an axial end surface orthogonal to the axis of rotation; and, an indentation in the axial end surface;

the indentation is bounded:

in the first circumferential direction by a first surface of the rotor; and, in a second circumferential direction, opposite the first circumferential direction, by a second surface of the rotor;

the first tab is disposed in the indentation of the rotor;

the second timing feature is bounded:

by a third surface of the rotor in the first circumferential direction; and, by a fourth surface of the rotor in the second circumferential direction;

the first surface of the rotor and the second surface of the rotor are separated by a first distance in the first circumferential direction; and, the third surface of the rotor and the fourth surface of the rotor are separated by a second distance in the first circumferential direction; and, a maximum value of the second distance is less than a minimum value of the first distance.

14. The camshaft phaser of claim 1, wherein:

the target wheel further includes a second tab;

the spring is:

axially disposed between the first tab and the second tab; and, in contact with the first tab and the second tab; and, the first tab and the second tab fix an axial position of the target wheel with respect to the rotor.

15. A camshaft phaser, comprising:

an axis of rotation;

a target wheel including:

a first tab, the first tab bounded in a first circumferential direction by a first surface of the target wheel;

a second tab; and, a first timing feature bounded in a second circumferential direction, opposite the first circumferential direction, by a second surface of the target wheel;

a stator arranged to receive rotational torque and including a plurality of radially inwardly extending protrusions;

a rotor including:

a second timing feature bounded in the second circumferential direction by a first surface of the rotor;

an axial end surface orthogonal to the axis of rotation;

an indentation in the axial end surface; and, a plurality of radially outwardly extending protrusions circumferentially interleaved with the plurality of radially inwardly extending protrusions; and, a spring urging:

the target wheel in the first circumferential direction with respect to the rotor; and, the second surface of the target wheel and the first surface of the rotor into contact, wherein:

the first tab is disposed in the indentation of the rotor;

the first tab and the second tab connect the target wheel to the spring; and, the target wheel is arranged to interface with a position sensor.

16. The camshaft phaser of claim 15, wherein:

the indentation of the rotor is bounded in the first circumferential direction by a second surface of the rotor; and, the first surface of the target wheel is free of contact with the second surface of the rotor.

17. The camshaft phaser of claim 15, wherein:

the indentation of the rotor is bounded in the first circumferential direction by a second surface of the rotor; and, the first surface of the target wheel is in contact with the second surface of the rotor.

18. A method of operating a camshaft phaser, the camshaft phaser including: a stator including a plurality of radially inwardly extending protrusions; a target wheel including a first timing feature, a first tab, and a second tab; a rotor including a second timing feature and a plurality of radially outwardly extending protrusions circumferentially interleaved with the plurality of radially inwardly extending protrusions; and a spring, the method comprising:

connecting, with the first tab and the second tab, the target wheel to the spring;

urging, with the spring, the target wheel in a first circumferential direction with respect to the rotor;

contacting the second timing feature with the first timing feature;

blocking rotation of the target wheel, with respect to the rotor and in the first circumferential direction; and, identifying, with the target wheel and a position sensor, a rotational position of the rotor.

19. The method of claim 18, wherein:

the rotor further includes an indentation in an axial end surface, orthogonal to an axis of rotation of the camshaft phaser, of the rotor;

the first tab is:

bounded in the first circumferential direction by a first surface of the target wheel; and, disposed in the indentation of the rotor;

the indentation of the rotor is bounded in the first circumferential direction by a first surface of the rotor;

the first timing feature is bounded in a second circumferential direction, opposite the first circumferential direction, by a second surface of the target wheel;

the second timing feature is bounded in the second circumferential direction by a second surface of the rotor; and, contacting the second timing feature with the first timing feature includes:

contacting the second surface of the rotor with the second surface of the target wheel; and, preventing contact between the first surface of the target wheel and the first surface of the rotor.

20. The method of claim 18, wherein:

the rotor further includes an indentation in an axial end surface, orthogonal to an axis of rotation of the camshaft phaser, of the rotor;

the first tab is:

bounded in the first circumferential direction by a first surface of the target wheel; and, disposed in the indentation of the rotor;

the indentation of the rotor is bounded in the first circumferential direction by a first surface of the rotor;

the first timing feature is bounded in a second circumferential direction, opposite the first circumferential direction, by a second surface of the target wheel;

the second timing feature is bounded in the second circumferential direction by a second surface of the rotor; and, contacting the second timing feature with the first timing feature includes:

contacting the second surface of the rotor with the second surface of the target wheel; and, contacting the first surface of the rotor and the first surface of the target wheel.

* * * * *